US006532752B1

(12) United States Patent
Arman et al.

(10) Patent No.: US 6,532,752 B1
(45) Date of Patent: Mar. 18, 2003

(54) FOOD FREEZING SYSTEM

(75) Inventors: Bayram Arman, Grand Island, NY (US); Dante Patrick Bonaquist, Grand Island, NY (US); Arthur Edward Holmer, Rensselaerville, NY (US); Raymond Paul Roberge, Chappaqua, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/107,788

(22) Filed: Mar. 28, 2002

(51) Int. Cl.[7] ..... F25B 4/00
(52) U.S. Cl. ..... 62/114
(58) Field of Search ..... 62/114, 513, 515, 62/529, 467

(56) References Cited

U.S. PATENT DOCUMENTS

| | | | | |
|---|---|---|---|---|
| 4,856,285 | A | 8/1989 | Acharya et al. | 62/63 |
| 5,265,443 | A | 11/1993 | Yuzawa et al. | 62/498 |
| 5,267,449 | A | 12/1993 | Kiczek et al. | 62/86 |
| 5,650,089 | A | 7/1997 | Gage et al. | 252/67 |
| 6,076,372 | A | 6/2000 | Acharya et al. | 62/606 |
| 6,176,102 | B1 | 1/2001 | Novak et al. | 62/612 |
| 6,327,866 | B1 | 12/2001 | Novak et al. | 62/114 |
| 6,330,811 | B1 * | 12/2001 | Arman et al. | 62/643 |

* cited by examiner

*Primary Examiner*—William C. Doerrler
*Assistant Examiner*—Malik N. Drake
(74) *Attorney, Agent, or Firm*—Stanley Ktorides

(57) ABSTRACT

A food freezing system wherein refrigeration is generated by compressing, cooling and then expanding a defined multi-component refrigerant mixture, which, after providing refrigeration to the food, is warmed against itself to effect the cooling.

34 Claims, 1 Drawing Sheet

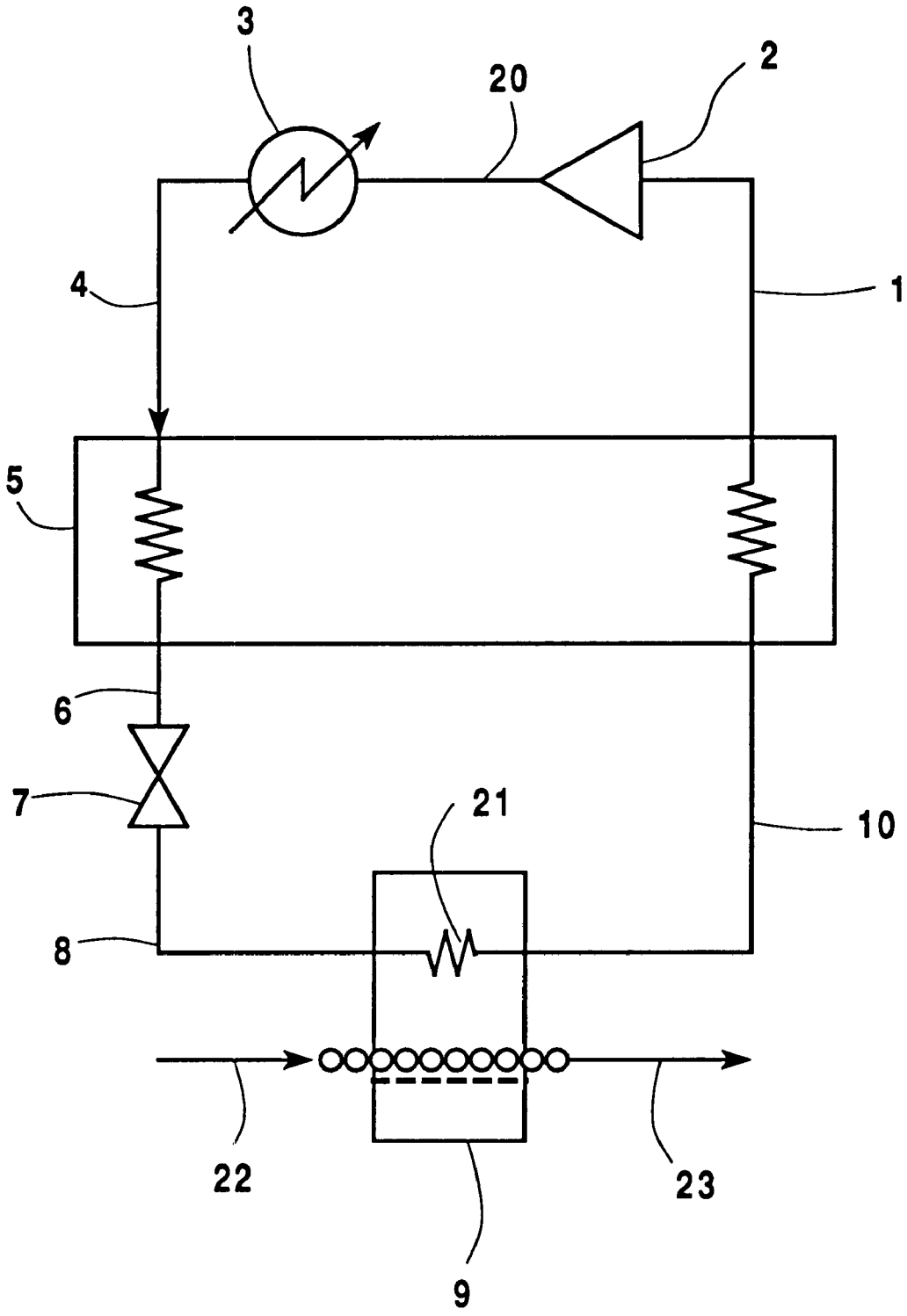
3
20
2
4
1
5
6
7
21
10
8
22
23
9

FOOD FREEZING SYSTEM

TECHNICAL FIELD

This invention relates generally to food freezing and also to defined refrigerant mixtures for generating refrigeration therefor.

BACKGROUND ART

Ammonia has long been used as the refrigerant for commercial food freezing because of its low cost. Generating refrigeration is an energy intensive process and, as energy costs continue to rise, it is desirable to have a refrigeration system which can provide comparable refrigeration for food freezing as can an ammonia system but with lower unit energy costs.

In addition to high power requirements, ammonia refrigeration systems have high capital costs and require significant physical space. It is desirable to have a refrigeration system for food freezing which has lower capital costs and requires less physical space than does a comparable ammonia refrigeration system.

Accordingly it is an object of this invention to provide a food freezing system which employs refrigeration generated using a system which has advantages over conventional ammonia refrigeration systems.

It is another object of this invention to provide a refrigerant mixture which can generate refrigeration for use in food freezing with an advantage over refrigeration generated from ammonia.

SUMMARY OF THE INVENTION

The above and other objects, which will become apparent to those skilled in the art upon a reading of this disclosure, are attained by the present invention, one aspect of which is:

A method for freezing food comprising:

(A) compressing a refrigerant mixture comprising ammonia and at least one other component from the group consisting of hydrofluorocarbons and fluoroethers;

(B) cooling the compressed refrigerant mixture and expanding the cooled compressed refrigerant mixture to generate refrigeration;

(C) providing refrigeration from the expanded refrigerant mixture to food for freezing said food; and (D) warming the expanded refrigerant mixture to effect at least in part the said cooling of the compressed refrigerant mixture.

Another aspect of the invention is:

A refrigerant mixture for generating refrigeration for use for freezing food, said refrigerant mixture comprising ammonia and at least one other component from the group consisting of hydrofluorocarbons and fluoroethers.

As used herein the term "food" means material intended for human or animal consumption and includes pharmaceuticals and other biological or organic materials.

As used herein the term "freezing" means to provide refrigeration to food at a temperature of 260 K or less. Freezing includes chilling food, converting food to a frozen state, and/or maintaining food in a frozen or chilled state.

As used herein the term "direct heat transfer" means the passing of refrigeration from a refrigerant mixture to food with contact of the refrigerant mixture with the food.

As used herein the term "indirect heat transfer" means the passing of refrigeration from a refrigerant mixture to food without contact of the refrigerant mixture with the food.

As used herein the term "indirect heat exchange" means the bringing of fluids into heat exchange relation without any physical contact or intermixing of the fluids with each other.

As used herein the term "expansion" means to effect a reduction in pressure.

As used herein the term "hydrofluorocarbon" means a species whose molecular formula has only carbon and fluorine atoms, or a species whose molecular formula has only carbon, fluorine and hydrogen atoms.

As used herein the term "fluoroether" means a species whose molecular formula has only carbon, fluorine and oxygen atoms, or a species whose molecular formula has only carbon, fluorine, oxygen and hydrogen atoms.

As used herein the term "variable load refrigerant" means a refrigerant mixture having components in proportions such that the liquid phase of its components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for a variable load refrigerant generally is at least 5° K.

BRIEF DESCRIPTION OF DRAWING

The sole FIGURE is a schematic representation of one preferred embodiment of the food freezing system of this invention.

DETAILED DESCRIPTION

The invention will be described in detail with reference to the Drawing. Referring now to the FIGURE, refrigerant mixture 1 is compressed by passage through compressor 2 to a pressure generally within the range of from 30 to 1000 pounds per square inch absolute (psia). Resulting pressurized refrigerant mixture 20 is passed to aftercooler 3 wherein the heat of compression is removed, and resulting refrigerant mixture 4 is passed to heat exchanger 5.

The refrigerant mixture of this invention comprises ammonia and at least one other component from the group consisting of hydrofluorocarbons and fluoroethers. The ammonia is present in a concentration of at least 5 mole percent and at most 95 mole percent. Preferably the ammonia is present in a concentration within the range of from 10 to 70 mole percent.

Among the hydrofluorocarbons which may be used in the practice of this invention one can name tetrafluoromethane, trifluoromethane, difluoromethane, fluoromethane, fluoroethane, difluoroethane, trifluoroethane, tetrafluoroethane, pentafluoroethane, perfluoropropane, heptafluoropropane, hexafluoropropane, pentafluoropropane, tetrafluoropropane, trifluoropropane, difluoropropane, perfluorobutane, perfluorohexane, perfluoropentene, pentafluorobutane, hexafluorobutane and decafluoropentane.

Among the fluoroethers which may be used in the practice of this invention one can name perfluorobutoxy-ethane, perfluorobutoxy-methane, perfluoropropoxy-ethane, perfluoropropoxy-methane, perfluoroethoxy-ethane, perfluoroethoxy-methane, perfluoromethoxy-methane, and perfluoromethoxy-perfluoromethane.

The hydrofluorocarbon(s) and/or fluoroether(s) may comprise the balance of the refrigerant mixture of the invention. However other components could also be present in the refrigerant mixture of this invention. For example, carbon dioxide may be used in the refrigerant mixture, and when it is used, it is present in a concentration generally within the range of from 5 to 90 mole percent. Nitrous oxide may also be used in the refrigerant mixture of this invention, and when it is used, it is present in a concentration generally within the range of from 2 to 30 mole percent. Other components which may be present in the refrigerant mixture of this invention include krypton, xenon, nitrogen, oxygen, argon, $NF_3$, one or more fluoroamines, and one or more hydrocarbons.

Preferably the components of the refrigerant mixture of this invention are present in concentrations such that the refrigerant mixture is a variable load refrigerant.

By the use of the defined refrigerant mixture and method of this invention, refrigeration may be generated and provided for food freezing with lower power requirements, lower capital costs and/or with reduced space requirements compared to conventional refrigeration systems on an equivalent refrigeration basis.

In one preferred embodiment the refrigerant mixture of this invention contains at least three components. In another preferred embodiment the refrigerant mixture of this invention contains at least four components.

In a further preferred embodiment of the refrigerant mixture of this invention is comprised solely of ammonia and one or more hydrofluorocarbons. In a further preferred embodiment the refrigerant mixture of this invention is comprised solely of ammonia and one or more fluoroethers. In a further preferred embodiment the refrigerant mixture of this invention is comprised solely of ammonia, hydrofluorocarbon(s) and fluoroether(s).

The following tables set forth certain preferred examples of the refrigerant mixture of this invention. In these tables the composition of the individual components is given in mole percent.

| COMPONENT | COMPOSITION |
|---|---|
| Perfluoropropoxy-methane | 5–70 |
| Ammonia | 5–70 |
| Trifluoromethane | 5–50 |
| Ethane | 0–30 |
| Tetrafluoromethane | 3–50 |
| Krypton | 0–20 |
| Perfluoropropoxy-methane | 5–70 |
| Ammonia | 5–70 |
| Pentafluoroethane | 5–50 |
| Ethane | 0–30 |
| Tetrafluoromethane | 3–50 |
| Krypton | 0–20 |
| Pentafluoroethane | 5–70 |
| Ammonia | 5–70 |
| Trifluoromethane | 5–50 |
| Ethane | 0–30 |
| Tetrafluoromethane | 3–50 |
| Krypton | 0–20 |
| Perfluoropropoxy-methane | 5–70 |
| Ammonia | 5–70 |
| Trifluoromethane | 0–50 |

-continued

| COMPONENT | COMPOSITION |
|---|---|
| Perfluoropropoxy-methane | 5–70 |
| Ammonia | 5–70 |
| Trifluoromethane | 5–50 |
| Tetrafluoromethane | 0–50 |
| Perfluoropropoxy-methane | 5–70 |
| Ammonia | 5–70 |
| Trifluoromethane | 5–50 |
| Ethane | 5–30 |
| Tetrafluoromethane | 0–50 |

Referring back now to the FIGURE, compressed refrigerant mixture 4 is cooled by passage through heat exchanger 5 by indirect heat exchange with returning refrigerant mixture as will be more fully described below. Preferably the cooling of the refrigerant mixture against the returning stream results in at least partial condensation, most preferably complete condensation, of the compressed refrigerant mixture. The resulting cooled, compressed refrigerant mixture 6 is expanded, such as through expansion valve 7, to a pressure generally within the range of from 3 to 100 psia. The expansion generates refrigeration by the Joule-Thomson effect, thereby further reducing the temperature of the refrigerant mixture.

The refrigeration bearing refrigerant mixture 8, generally having a temperature within the range of from 110 to 260 K, is used to provide refrigeration to food for freezing the food. The embodiment of the invention illustrated in the FIGURE is a preferred embodiment employing one indirect heat transfer step for the provision of the refrigeration from the refrigerant mixture to the food.

Refrigeration bearing refrigerant mixture 8 is passed through food freezing chamber 9 in heat exchange passage 21 thereby cooling by indirect heat exchange the atmosphere within freezing chamber 9. Food 22 is passed into food freezing chamber 9 wherein it contacts the refrigerated atmosphere and undergoes freezing. The resulting frozen food 23 is then withdrawn from food freezing chamber 9. If desired the refrigeration may be provided from the refrigerant mixture to the food by direct heat transfer wherein the refrigeration bearing refrigerant fluid is passed directly into food freezing chamber 9 and directly contacts the food. If desired the refrigeration may be provided from the refrigerant mixture to the food by indirect heat transfer using more than one step. For example, the refrigeration bearing refrigerant fluid may be used to cool an intermediate fluid which is then used to cool by indirect heat exchange the atmosphere of chamber 9.

Among the many foods which may be frozen with the use of this invention one can name meats such as hamburger, fish and poultry such as shrimp, milk and dairy products such as ice cream, and juices such as frozen orange juice.

Referring back now to the FIGURE, refrigerant mixture 10, which typically is at least partially in the vapor state, is passed from freezing chamber 9 to heat exchanger 5. As returning refrigerant mixture 10 traverses heat exchanger 5 it is warmed and any liquid portion of the mixture vaporized by indirect heat exchange with the aforedescribed cooling compressed refrigerant mixture passed into heat exchanger 5 in stream 4. The resulting warmed refrigerant mixture is withdrawn from heat exchanger 5 as stream 1 and the refrigeration circuit is completed and the refrigeration cycle starts anew.

Although the invention has been described in detail with reference to certain preferred embodiments, those skilled in the art will recognize that there are other embodiments of the invention within the spirit and the scope of the claims.

What is claimed is:

1. A method for freezing food comprising:

(A) compressing a refrigerant mixture comprising ammonia and at least one other component from the group consisting of hydrofluorocarbons and fluoroethers;

(B) cooling the compressed refrigerant mixture and expanding the cooled compressed refrigerant mixture to generate refrigeration;

(C) providing refrigeration from the expanded refrigerant mixture to food for freezing said food; and (D) warming the expanded refrigerant mixture to effect at least in part the said cooling of the compressed refrigerant mixture and wherein the cooling of the compressed refrigerant mixture at least partially condenses the compressed refrigerant mixture.

2. The method of claim 1 wherein the provision of refrigeration from the expanded refrigerant mixture to food is by indirect heat transfer.

3. The method of claim 1 wherein the provision of refrigeration from the expanded refrigerant mixture to food is by direct heat transfer.

4. The method of claim 1 wherein the refrigerant mixture is a variable load refrigerant.

5. The method of claim 1 wherein the refrigerant mixture additionally contains carbon dioxide.

6. The method of claim 1 wherein the refrigerant mixture additionally contains nitrous oxide.

7. The method of claim 1 wherein the refrigerant mixture additionally contains one or more hydrocarbons.

8. A method for freezing food comprising:

(A) compressing a refrigerant mixture comprising ammonia and at least one other component from the group consisting of hydrofluorocarbons and fluoroethers;

(B) cooling the compressed refrigerant mixture and expanding the cooled compressed refrigerant mixture to generate refrigeration;

(C) providing refrigeration from the expanded refrigerant mixture to food for freezing said food; and (D) warming the expanded refrigerant mixture to effect at least in part the said cooling of the compressed refrigerant mixture and wherein the provision of refrigeration from the expanded refrigerant mixture to food is by direct heat transfer.

9. A refrigerant mixture for generating refrigeration for use for freezing food, said refrigerant mixture comprising from 5 to 70 mole percent ammonia, from 5 to 70 mole percent perfluoropropoxy-methane, from 5 to 50 mole percent trifluoromethane, from 3 to 50 mole percent tetrafluoromethane, from 0 to 30 mole percent ethane, and from 0 to 20 mole percent krypton.

10. The refrigerant mixture of claim 9 additionally containing carbon dioxide.

11. The refrigerant mixture of claim 9 additionally containing nitrous oxide.

12. The refrigerant mixture of claim 9 additionally containing one or more of xenon, nitrogen, oxygen and argon.

13. A refrigerant mixture for generating refrigeration for use for freezing food, said refrigerant mixture comprising from 5 to 70 mole percent ammonia, from 5 to 70 mole percent perfluoropropoxy-methane, from 5 to 50 mole percent pentafluoroethane, from 3 to 50 mole percent tetrafluoromethane, from 0 to 30 mole percent ethane, and from 0 to 20 mole percent krypton.

14. The refrigerant mixture of claim 13 additionally containing carbon dioxide.

15. The refrigerant mixture of claim 13 additionally containing nitrous oxide.

16. The refrigerant mixture of claim 13 additionally containing one or more of xenon, nitrogen, oxygen and argon.

17. A refrigerant mixture for generating refrigeration for use for freezing food, said refrigerant mixture comprising from 5 to 70 mole percent ammonia, from 5 to 70 mole percent pentafluoroethane, from 5 to 50 mole percent trifluoromethane, from 3 to 50 mole percent tetrafluoromethane, from 0 to 30 mole percent ethane, and from 0 to 20 mole percent krypton.

18. The refrigerant mixture of claim 17 additionally containing carbon dioxide.

19. The refrigerant mixture of claim 17 additionally containing nitrous oxide.

20. The refrigerant mixture of claim 17 additionally containing one or more xenon, nitrogen, oxygen and argon.

21. A refrigerant mixture for generating refrigeration for use for freezing food, said refrigerant mixture comprising from 5 to 70 mole percent ammonia, from 5 to 70 mole percent perfluoropropoxy-methane, and from 0 to 50 mole percent trifluoromethane.

22. The refrigerant mixture of claim 21 additionally containing carbon dioxide.

23. The refrigerant mixture of claim 21 additionally containing nitrous oxide.

24. The refrigerant mixture of claim 21 additionally containing one or more hydrocarbons.

25. The refrigerant mixture of claim 21 additionally containing one or more of krypton, xenon, nitrogen, oxygen and argon.

26. A refrigerant mixture for generating refrigeration for use in freezing food, said refrigerant mixture comprising from 5 to 70 mole percent ammonia, from 5 to 70 mole percent perfluoropropoxy-methane, from 5 to 50 mole percent trifluoromethane and from 0 to 50 mole percent tetrafluoromethane.

27. The refrigerant mixture of claim 26 additionally containing carbon dioxide.

28. The refrigerant mixture of claim 26 additionally containing nitrous oxide.

29. The refrigerant mixture of claim 26 additionally containing one or more hydrocarbons.

30. The refrigerant mixture of claim 26 additionally containing one or more of krypton, xenon, nitrogen, oxygen and argon.

31. A refrigerant mixture for generating refrigeration for use for freezing food, said refrigerant mixture comprising from 5 to 70 mole percent ammonia, from S to 70 mole percent perfluoropropoxy-methane, from 5 to 50 mole percent trifluoromethane, from 5 to 30 mole percent ethane, and from 0 to 50 mole percent tetrafluoromethane.

32. The refrigerant mixture of claim 31 additionally containing carbon dioxide.

33. The refrigerant mixture of claim 31 additionally containing nitrous oxide.

34. The refrigerant mixture of claim 31 additionally containing one or more of krypton, xenon, nitrogen, oxygen and argon.

* * * * *

UNITED STATES PATENT AND TRADEMARK OFFICE

CERTIFICATE OF CORRECTION

PATENT NO. : 6,532,752 B1
DATED : March 18, 2003
INVENTOR(S) : Arman et al.

It is certified that error appears in the above-identified patent and that said Letters Patent is hereby corrected as shown below:

Column 3, line 48 to Column 4, line 13,
Delete the single table which appears in the patent and replace it with the following 6 tables which are presented in the patent application:

--

| COMPONENT | COMPOSITION |
|---|---|
| Perfluoropropoxy-methane | 5-70 |
| Ammonia | 5-70 |
| Trifluoromethane | 5-50 |
| Ethane | 0-30 |
| Tetrafluoromethane | 3-50 |
| Krypton | 0-20 |

| COMPONENT | COMPOSITION |
|---|---|
| Perfluoropropoxy-methane | 5-70 |
| Ammonia | 5-70 |
| Pentafluoroethane | 5-50 |
| Ethane | 0-30 |
| Tetrafluoromethane | 3-50 |
| Krypton | 0-20 |

| COMPONENT | COMPOSITION |
|---|---|
| Perfluoropropoxy-methane. | 5-70 |
| Ammonia | 5-70 |
| Trifluoromethane | 5-50 |
| Ethane | 5-30 |
| Tetrafluoromethane | 0-50 |

--

UNITED STATES PATENT AND TRADEMARK OFFICE

CERTIFICATE OF CORRECTION

PATENT NO. : 6,532,752 B1
DATED : March 18, 2003
INVENTOR(S) : Arman et al.

It is certified that error appears in the above-identified patent and that said Letters Patent is hereby corrected as shown below:

Column 6,
Line 53, delete “S” and insert therefor -- 5 --.

Signed and Sealed this

Twenty-second Day of July, 2003

JAMES E. ROGAN
*Director of the United States Patent and Trademark Office*